United States Patent [19]

Peppers

[11] Patent Number: 4,672,786

[45] Date of Patent: Jun. 16, 1987

[54] VALVE SEAT GRINDING APPARATUS

[75] Inventor: James M. Peppers, Houston, Tex.

[73] Assignee: Unislip, Inc., Merriville, Ind.

[21] Appl. No.: 843,292

[22] Filed: Mar. 24, 1986

[51] Int. Cl.[4] ..... B24B 15/02

[52] U.S. Cl. ..... 51/241 VS; 403/57

[58] Field of Search ..... 51/241 R, 241 VS, 241 A, 51/241 B, 245, 120; 403/57

[56] References Cited

U.S. PATENT DOCUMENTS 1,304,757 5/1919 Fox ..... 403/57

4,287,688 9/1981 Jensen ..... 51/241 VS

*Primary Examiner*—Roscoe V. Parker

*Attorney, Agent, or Firm*—Matthews & Associates

[57] ABSTRACT

Valve seat grinding apparatus incorporating an improved articulated rotatable torque transferring coupling. The coupling includes torque transfer member in connection with a pair of functionally cylindrical torque members. Each torque member includes a circular torque transfer spline with the axis of spline being disposed perpendicular to the axis of torque member. The spline has an opening of designated internal distance located at one end of torque member and centered with the axis of torque member. A pair of circular torque transfer grooves are defined into torque transfer member which cross at right angles on each side of torque transfer member to form a pair of intersections. The intersections form flat clearance surfaces with the distance between clearance surfaces being less than designated distance of internal diameter of opening. A splineway opening is defined through circular spline and across the axis of one of torque members to accommodate passage of spline of other said torque member of the torque members.

4 Claims, 9 Drawing Figures

VALVE SEAT GRINDING APPARATUS

FIELD OF THE INVENTION

The present invention generally relates to flow valve repair apparatus and more particularly, to improved valve seat grinding apparatus. This application is in improvement of U.S. patent application, Ser. No. 650,841, filed Sept. 17, 1984, and now U.S. Pat. No. 4,610,112.

BACKGROUND OF THE INVENTION

A valve seat grinding apparatus is disclosed in U.S. Pat. No. 4,287,688. As disclosed, the present invention is a combination of the kind as disclosed in this patent and, accordingly, the patent is hereby incorporated by reference. The above referenced Ser. No. 650,851 has of record the presently known prior art pertaining to valve grinding apparatus, including German GM No. 8303975 (1983). Also of record in the application Ser. No. 650,851 is Ser. No. 705,869, filed Feb. 28, 1985, which at present has been allowed but not yet issued. The disclosed ball component incorporated into the present invention is an adaptation of a small specimen of a flexible shaft torque transfer coupler understood to be commercially available in Germany.

OBJECTS OF THE INVENTION

An object of this invention is to provide seat grinding apparatus having a coupling, or "U-joint", in combination which is reliable, which is relatively simple to fabricate with automatic machines and which exhibits angular linear velocity in use.

Another object of this invention is to provide seat grinding apparatus having a coupling in combination which is simple to maintain and which delivers substantial torque relative to shaft size as needed in valve seat grinding apparatus.

SUMMARY OF THE INVENTION

The foregoing and other objects of the invention are attained by an improved valve seat grinding apparatus which includes a drive wheel of disk shape carrying a plurality of freely rotatable satellite wheels around its front periphery. The satellite wheels have planes of rotation which are disposed with respect to the axis of the drive wheel such that grinding faces on the satellite wheels are in appropriate position to grind a valve seat. An articulated torque transfer coupling is connected to the the drive wheel at its axis and adapted to transfer torque and axial force to the satellite wheels through the drive wheel to cause rotation of the satellite wheels around the valve seat and forcefully against the valve seat. The torque transfer coupling includes a driven torque member connected with the drive wheel and a driving torque member connected to a power drive source. The invention also includes apparatus for grinding a valve seat face including an integral grinding head adapted to become aligned with a designated valve seat responsive to force applied to the grinding head and to properly grind a valve seat face responsive to torque sufficient to rotate the grinding head. An articulated torque transfer coupling is connected to said grinding head at its axis and adapted to transfer torque and axial force to the grinding head to cause rotation of the grinding head and thereby to cause a grinding action between the grinding and a valve seat. The torque transfer coupling includes a driven torque member connected with the grinding head and a driving torque member connected to the power drive source.

The torque transfer coupling includes a central torque transferring member in connection with the driven torque member and the driving torque member. Each of the torque members includes a circular torque transfer spline with the axis of the spline being disposed perpendicular to the axis of the respective torque member. Each spline has a opening located at one end of the respective torque member. The opening is centered with the axis of the torque member and is of designated internal distance. A pair of circular torque transfer grooves are defined into the torque transfer member with the grooves crossing at right angles on each side of the torque transfer member to form a pair of intersections. The intersections form flat clearance surfaces with the distance between these clearance surfaces being less than the designated distance of the internal diameter of the spline opening. A splineway is defined through the circular spline of one of the torque members and across the axis of this torque member to accommodate passage of the spline of the other of the torque members.

In assembly, one torque transfer member is fitted into the spline of the torque member having the splineway and the flat surfaces are passed through the clearance opening to seat the spline into sliding relation within the respective torque transfer groove. The torque transfer member is rotated until one of the flat surfaces is in registry with the splineway cut through that spline, leaving an opening to accommodate the spline of the other spline transfer member as that spline is passed through the opening. The first and second torque members are then articulated until the axes of the torque members are in position for a rotatable torque transferring installation.

DESCRIPTION OF A PREFERRED EMBODIMENT

Figure 9:
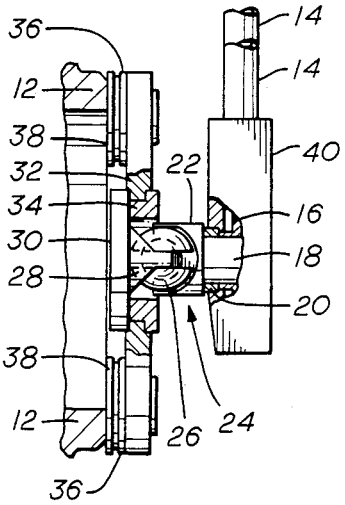
FIG. 9 is a partly sectional side elevational view of valve seat grinding apparatus into which the universal coupling shown in FIG. 1 has been incorporated in the combination.

First referring to FIG. 9, in view of FIGS. 1, 2, 4 and 5, there is shown the lower portion of a valve seat grinding apparatus 10 inserted down into a valve body (not shown) into grinding position against a valve seat 12. A pair of support tubes 14, supported from above, and carry a driving chain (not shown) which drives a sprocket 16 connected to a driven shaft 18. The shaft 18 extends through a support bearing 20 and is formed at its end as a driving torque member 22 of a universal coupling 24. The driving torque member 22 is connected through a torque transfer member 26 into a driven torque member 28. The driven torque member 28 is formed into a connection flange 30 which in turn is connected concentrically to a grinding drive wheel 32 with assistance of a retainer bushing 34.

Mounted around the periphery of the drive wheel 32 are a plurality of freely rotatable satellite grinding wheels 36. Each of the grinding wheels 36 has affixed on its forward face a replaceable grinding element 38, which made be made of emery cloth, for example.

The sprocket 16, shaft 18 and bearing 20 are mounted in a housing 40 which is supported from the support tubes 14.

Figure 1:
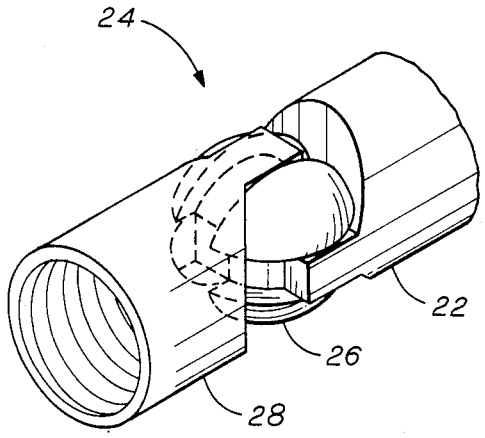
FIG. 1 is an isometric view of the universal coupling, as such, of the present invention.

It can be seen that the universal coupling 24, as shown in FIG. 9, is a modification of the coupling 24 as shown in FIG. 1 with the driving torque member 22 being formed at the end of shaft 18 and with the driven torque member 28 being formed with a flange 30.

Figure 2:
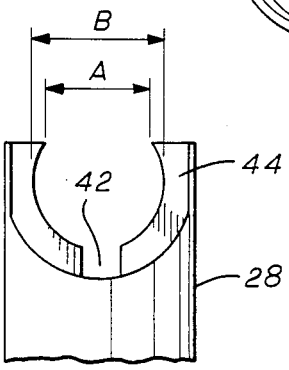
FIG. 2 is a side elevational view of the first torque member.
Figure 4:
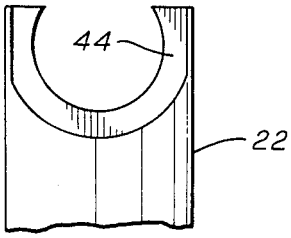
FIG. 4 is a side elevational view of the second torque member.

As will become more clear during the description of the assembly of the universal coupling 24, the assembly of the apparatus of FIG. 9 may be facilitated when the driven torque member 28 is formed as the first torque member, identified with FIG. 2, and the driving torque member 22 is formed as the second torque member, identified with FIG. 4.

Figure 5:
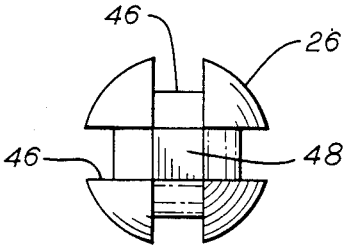
FIG. 5 is a side elevational view of the intermediate torque transfer member which fits between the first and the second torque members.
Figure 6:
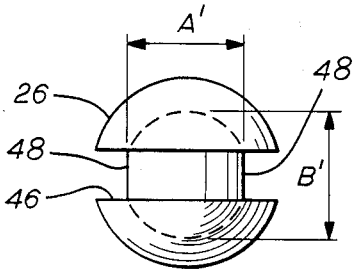
FIG. 6 is a side elevational view of the intermediate torque transfer member of FIG. 5 and taken at 90° from FIG. 5.

As a general description, the first torque member of FIG. 2 and the second torque member of FIG. 4 are in joint connection with the torque transfer member 26, shown in FIGS. 5 and 6.

It is seen that the torque member 22 and the torque member 28 are formed identically with exception of a splineway opening 42 formed in torque member 28 for a reason later shown. Each of torque members 22 and 28 are formed with a circular torque transfer spline 44 which is disposed at right angles or perpendicular to the axis of each torque member. The spline 44 of each torque member is formed with a opening A located at the spline end of each torque member.

Figure 3:
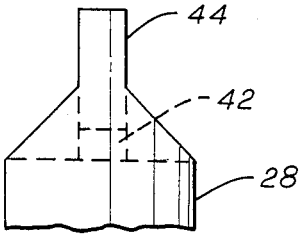
FIG. 3 is a side elevational view of the first torque member taken at 90° from FIG. 2.

The opening A is of dimension or diameter noticeably less than the internal diameter B of each circular transfer spline 44. As seen in FIGS. 2 and 3, the circular spline 44 is formed by milling into the end of torque member 28 and the splineway 42 is milled across the spline 44 at the axis of torque member 28. The torque member 22, as shown in FIG. 4, is milled in the same manner without the splineway 42, although the splineway 42 could be additionally milled in torque member 22, should it be desirable to make these two torque members identical, as on a programmed automatic machine.

As shown in FIGS. 5 and 6, the torque transfer member 26 may be generally spherical in shape for best articulation of the universal coupler 24. The member 26 has defined into its surface, two circular spline grooves 44 which are defined around the diameter of member 26 and disposed at 90° relative to one another.

The two grooves 44 form two oppositely disposed intersections 46 which are milled flat to a dimension of dimension A′ as shown. The bottom of each groove 44 is machined to an O.D. of B′.

The A′ dimension of intersections 46 are provided such that the diameter at intersections 46 will just clear the opening of dimension A, such as shown in FIG. 2, and thus allow the transfer member 26 to be inserted through the dimension A opening of both of the torque members 22 and 28.

The dimensions of the splines 44 and of the grooves 46 are such that the torque transfer member 26 will closely fit yet smoothly rotate within the splines 44. This close fit is between the sides of the grooves 46 and also by the relative clearance between dimensions B and B′.

Figure 7:
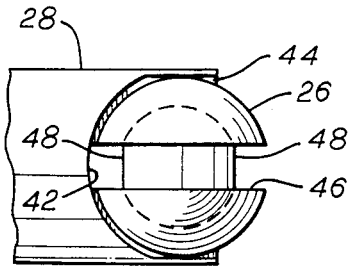
FIG. 7 is a side elevational view of the first torque member of FIG. 2 into which the intermediate torque transfer member of FIG. 6 has been assembled.
Figure 8:
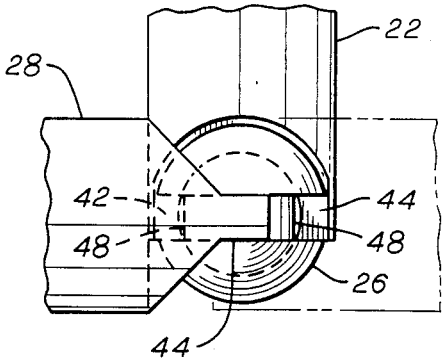
FIG. 8 is a side elevational view of the first torque member and the intermediate torque transfer member into which the second torque member of FIG. 4 has been inserted for assembly.

FIGS. 7 and 8 are illustrative of the parts assumed during assembly (or disassembly) of the universal coupling 24.

First, the member 26 is positioned such that intersection 46 will clear dimension A of the spline 44 and the member 26 is thereon inserted into the spline 44 and rotated 90° until the intersection 46 is in registry with the splineway groove 42, as shown in FIG. 7. The spline 44 of member 22 is then inserted into the combined clearance of an intersection 46 and splineway groove 42 with member 22 being inserted at right angles to member 28, as shown in FIG. 8. The member 22 is thereon rotated 90° with respect to member 28 such that the axes of members 28 and 22 are in alignment, or close to alignment, as dictated by the installation of the coupler 24.

It is to be noted that, once the members 22 and 28 are moved away from the 90°, say to angles from 125° to 180°, the coupler 24 cannot come apart either intentionally or inadvertently. It is also noted that the flat surfaces at intersection 46 are only a small part of the bearing area in contact between the splines 44 and the grooves 46 when the coupler 24 is installed for operation.

Referring now to FIG. 9, the coupler 24 is assembled by aligning and inserting the transfer member 26 into the driven torque member 28 as described with reference to FIG. 7. The member 26 is rotated for alignment of the flat surfaces 48 with splineway groove 42 and the driving member 22 is inserted as described with reference to FIG. 8. The member 22 and shaft 18 is then aligned with driven member 28 as previously described. The coupler 24 and shaft 18 is then inserted through the hole provided in drive wheel 32 until flange 30 is seated in its corresponding counterbore as shown. The retainer bushing 34 is then installed over and around the shaft 18 and connected together with flange 30 as shown.

It is noted that the internal diameter of retainer 34 limits the relative flexure of the coupler 24 and thereby the flexure of shaft 18 with relation to grinding wheel 32. However, the flexure of shaft 18 and coupler 24 is more than ample for the necessary articulation of drive wheel 32 while the retainer 34 prevents any articulation sufficiently great to allow the coupler 24 to become disassembled.

Due to the structure of coupler 24, which provides the combined slipping action of the splines of members 22 and 28 within the grooves 46 of the transfer member 26, the angular velocity of the drive wheel 32 remains the same as the angular velocity of shaft 18. Changes in angular velocity of the valve seat grinding apparatus, as shown, is not particularly significant with the low speeds involved. However, if the coupler 24 is used in combination with other higher speed apparatus, this feature may be of more importance.

It is to be seen, with reference to FIG. 1, that the driving torque member 22 or the driven member 28, or both members, may be provided with interior or exterior axial threaded connections (not shown), as appropriate.

It will be obvious to those skilled in this art that various changes and modifications may be made to the embodiment herein disclosed, all of which would be within the scope and purview of the appended claims.

What is claimed:

1. Apparatus for grinding a valve seat face comprising:

(a) a grinding head means adapted to become aligned with a designated valve seat responsive to force applied to said grinding head and to properly grind said valve face responsive to torque sufficient to rotate said grinding head;

(b) an articulated torque transfer coupling means connected to said grinding head at its axis and adapted to transfer torque and axial force to said grinding head to cause rotation of said head and thereby to cause a grinding action between said grinding head and said valve seat;

(c) said torque transfer coupling means including a driven torque member connected with said grinding head and a driving torque member connected to a power drive source, wherein the axes of said grinding head and said power drive source may vary from being in alignment to being in substantial misalignment;

(d) a torque transfer member in connection with said torque members;

(e) each torque member of said torque members including a circular torque transfer spline with the axis of said spline disposed perpendicular to the axis of each said torque member;

(f) said spline having an opening of designated internal distance located at one end of said torque member and centered with the axis of said torque member;

(g) a pair of circular torque transfer grooves defined into said torque transfer member and crossing at right angles on each side of said torque transfer member to form a pair of intersections;

(h) said intersections forming flat clearance surfaces with a distance between said clearance surfaces being less than said designated distance of said internal diameter of said opening;

(i) a splineway opening defined through the circular spline and across the axis of at least one of said torque members to accommodate passage of the spline of the other said torque member of said torque members;

(j) at least one of said torque members merging into a circular mounting flange with said mounting flange being connected into said grinding head with assistance of a retainer bushing; and (k) the internal diameter of said retainer bushing limiting the angle of deviation of the driving torque member from the driven torque member.

2. The apparatus of claim 1 wherein said splineway opening is defined through the circular spline of said driven member.

3. The apparatus of claim 1 wherein at least one of said torque members joins into a cylindrical shaft.

4. The apparatus of claim 1 wherein at least one of said torque members merges into a threaded connector.

* * * * *